United States Patent [19]

Schwecke

[11] Patent Number: 5,054,293

[45] Date of Patent: Oct. 8, 1991

[54] APPARATUS AND METHOD FOR PROTECTING A COMPRESSOR IN A HEAT PUMP

[76] Inventor: William Schwecke, 7092 Alert New London Rd., Okeana, Ohio 45053

[21] Appl. No.: 532,894

[22] Filed: Jun. 4, 1990

[51] Int. Cl.[5] ..... F25B 43/02

[52] U.S. Cl. ..... 62/84; 62/193; 62/126; 361/22

[58] Field of Search ..... 62/84, 192, 193, 126, 62/226, 228.1, 468, 472; 361/22; 219/501

[56] References Cited

U.S. PATENT DOCUMENTS

| | | | |
|---|---|---|---|
| 3,381,226 | 4/1968 | Jones et al. | 219/501 X |
| 3,577,741 | 5/1971 | Shaw | 62/84 |
| 3,920,955 | 11/1975 | Nakata | 219/501 |
| 4,004,431 | 1/1977 | Hildreth | 62/228 |

*Primary Examiner*—Harry B. Tanner

[57] ABSTRACT

Apparatus for protecting a compressor operating in a refrigeration device such as a heat pump includes a heater for maintaining lubricating oil contained in a crankcase of the compressor at a preselected temperature that will prevent the oil from absorbing any refrigerant. A control circuit is connected to an alternating current source of electrical power for controlling the operation of the compressor. The control circuit includes a thyristor having a blocking state and a conducting state. If the heater fails to operate, the thyristor will be disposed in the blocking state thereby preventing the compressor from operating. The control circuit also includes a trigger for changing the thyristor from the blocking state to the conducting state, and a full wave bridge or rectifier for converting the voltage drop across the thyristor from an alternating current voltage to a direct current voltage.

5 Claims, 1 Drawing Sheet

APPARATUS AND METHOD FOR PROTECTING A COMPRESSOR IN A HEAT PUMP

BACKGROUND OF THE INVENTION

This invention relates generally to refrigeration devices such as heat pumps and, in particular, to apparatus and a method for protecting a compressor in a heat pump.

Heat pumps typically include a compressor for compressing refrigerants, e.g. freon. The compressor has a crankcase containing lubricating oil and refrigerant, and a heater is provided for keeping the lubricating oil in the crankcase warm enough to prevent accumulation of any liquid refrigerant in the compressor. Proper operation of the crankcase heater is important because if the refrigerant is in a liquid state when the compressor starts, the compressor could fail resulting in a very expensive repair job. It is believed that many compressor failures in heat pumps result from failure of the crankcase heater.

U.S. Pat. No. 4,004,431 granted Jan. 25, 1977 to T. L. Hildreth discloses a cooling unit having an evaporator fan, a compressor, and a heater for the compressor. A control circuit which includes a thermostat that senses temperature changes in the compressor housing prevents actuation of the compressor until the heater raises the temperature of the compressor to a predetermined level. The control circuit also shuts down the compressor if the temperature of the compressor falls a predetermined amount or reaches a predetermined point. A drawback of the Hildreth control circuit is that the thermostat must be mounted directly on the compressor housing in order to accurately sense temperature changes. Another drawback of the Hildreth control circuit is that cold air flow from the evaporator fan may be detected by the thermostat thereby causing the compressor to be shut down inadvertently.

U.S. Pat. No. 3,577,741 granted May 4, 1971 to D. N. Shaw discloses a refrigeration unit including a compressor with a crankcase, a heating element on the compressor crankcase, and a control circuit for preventing energization of the compressor if the heating element is not functioning. The control circuit includes relays and switches that cooperate to energize and deenergize the compressor depending upon the condition of the heating element. A drawback of the Shaw control circuit is that it is too complex requiring major changes in a conventional refrigeration unit such as a heat pump. For example, it reduces the output of the heating element thus requiring the installation of a larger heating element which has a higher operating cost.

SUMMARY OF THE INVENTION

The present invention provides apparatus and a method for protecting a compressor operating in a refrigeration device such as a heat pump thereby preventing failure of the compressor without the drawbacks of the prior Hildreth and Shaw control circuits.

The apparatus of the present invention includes heater means for maintaining lubricating oil contained in a crankcase of a compressor at a preselected temperature. Control means are connected to a source of electrical power for controlling the operation of the compressor. The control means includes a thyristor having a blocking state and a conducting state. If the heater means fails to operate, the thyristor is disposed in the blocking state thereby preventing the compressor from operating.

DESCRIPTION OF THE PREFERRED EMBODIMENT

Figure 1:
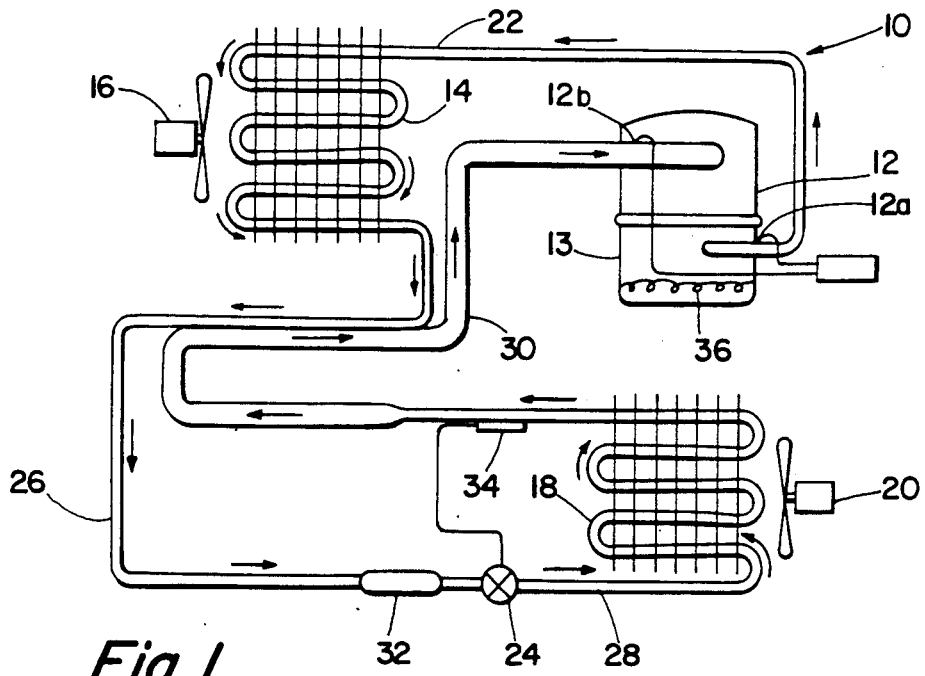
FIG. 1 is a schematic view of a typical heat pump illustrating various components thereof.

Referring to FIG. 1, a refrigeration unit or heat pump 10 includes a compressor 12, a condenser 14, a condenser fan 16, an evaporator 18 and an evaporator fan 20. Compressor 12 has a crankcase 13 containing lubricating oil and refrigerant. The discharge side **12*a* of the compressor 12 is connected to the condenser 14 by a high pressure line 22, and the condenser 14 is connected to an expansion valve or capillary tube 24 by a high pressure line 26. The expansion valve 24 is connected to the evaporator 18 by a low pressure line 28, and the evaporator 18 is connected to the suction side 12*b* of the compressor 12 by a low pressure line 30**.

A strainer/drier 32 is installed in the high pressure line 26 between the condenser 14 and the expansion valve 24. A valve-sensor bulb 34 is provided on the low pressure line 30 to control the operation of the expansion valve 24.

During normal operation of the heat pump 10, highly compressed refrigerant in a gaseous or vapor state flows from the discharge side **12*a* of the compressor 12 through the high pressure line 22 to the condenser 14 where it is cooled by the condenser fan 16 blowing ambient air over the condenser 14. This condenses the refrigerant into a liquid which then flows through the high pressure line 26 and the expansion valve 24 before entering the low pressure line 28 connected to the evaporator 18. The liquid refrigerant is evaporated by the action of the evaporator fan 20 as it passes through the evaporator 18. Gaseous refrigerant flows from the evaporator 18 through the low pressure line 30 to the suction side 12*b* of the compressor 12 thereby completing a full cycle of the heat pump 10**.

In accordance with the present invention, a heater 36 is provided on the compressor 12 to maintain the lubricating oil and refrigerant in the crankcase 13 at a preselected temperature that will prevent the oil from absorbing any refrigerant. Heater 36 is preferably of the electrical resistance type and may be installed directly in the crankcase 13 of the compressor 12 in contact with the lubricating oil or wrapped around the outer surface of the crankcase 13. Heater 36 will remain on regardless of whether the heat pump 10 is operating.

Figure 2:
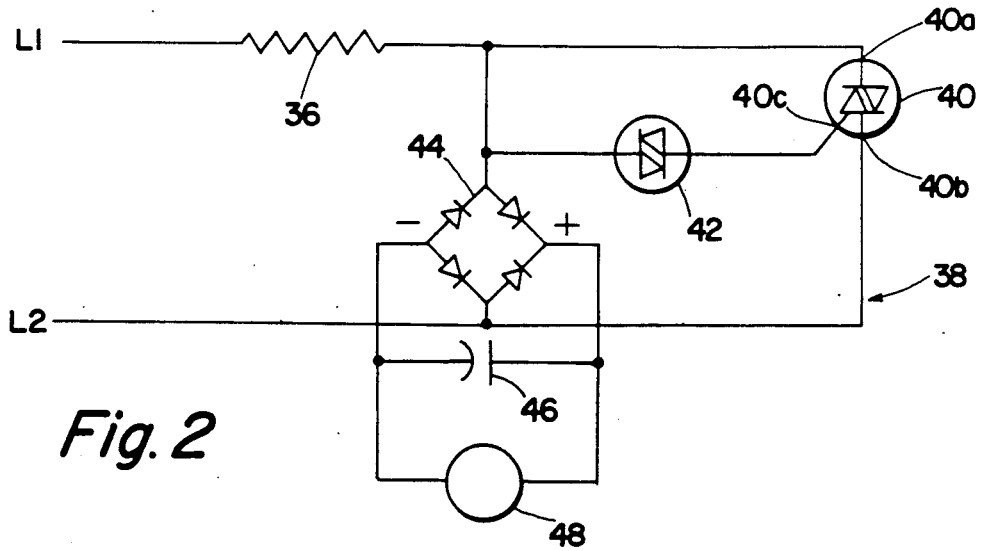
FIG. 2 is a schematic view of a control circuit according to the preferred embodiment of the present invention.
Figure 3:
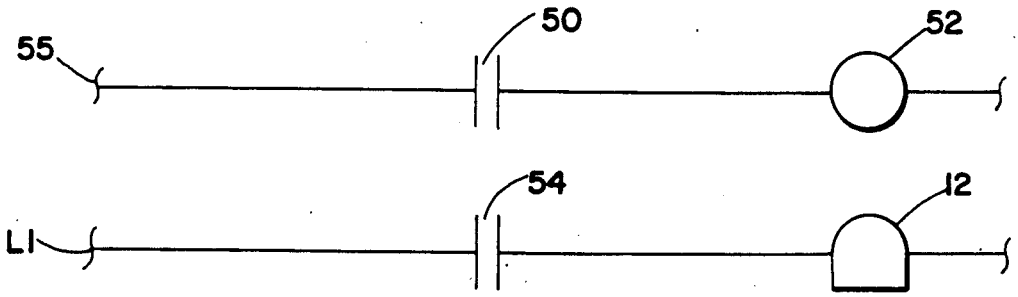
FIG. 3 is a schematic view of another part of the control circuit shown in FIG. 2.

Referring to FIGS. 2 and 3, a control circuit 38 is connected to an alternating current source of electrical power as represented by the lines L1, L2. Control circuit 38 includes the heater 36, a thyristor 40, a trigger 42, a full wave bridge or rectifier 44, a capacitor 46 and a direct current relay 48. A first contact 50 is connected between low control voltage 55 and the compressor relay 52, and a second set of contacts 54 is connected between the power source L1 and L2 and the compressor 12.

Thyristor 40 normally assumes a blocking or "off" state and remains in that state until triggered by the trigger 42 to an "on" or conducting state. Once triggered, the thyristor 40 remains on until the current is reduced to zero. Thyristor 40 then returns to the blocking state. Since the current decreases to zero every half cycle in an alternating current system, thyristor 40 is turned off every half cycle. When the thyristor 40 is turned on, it remains on until the voltage across its main terminals 40*a* and 40*b* is reduced below the value required to sustain conduction. The thyristor 40 cannot be turned off by reversing the polarity of the voltage across the main terminals 40*a*, 40*b*. Such a reversal of polarity merely causes current to flow in the opposite direction.

Thyristor 40 is a conventional bi-directional device used in alternating current systems. This type of device is low cost, small, reliable and simple. Thyristor 40 has three electrodes which are referred to as first main terminal 40*a*, second main terminal 40*b* and gate 40*c*. It will be understood that the gate 40*c* is designed so that either positive or negative voltage triggers the thyristor 40 into conduction for either polarity of the voltage across the main terminals 40*a*, 40*b*.

The control circuit 38 of the present invention protects the compressor 12 by preventing the compressor 12 from starting whenever the heater 36 fails causing the temperature of compressor 12 to drop low enough to cause absorption of refrigerant into the lubricating oil. During normal operation of the heat pump 10 with the compressor 12 running, the lubricating oil in the crankcase 13 is free of refrigerant because of the internal temperature and pressure of the compressor 12.

The control circuit 38 operates as follows. Thyristor 40 is in the blocking state until the heater 36 is connected and voltage is applied to the power source L1, L2. When the heater 36 is connected and voltage is applied to terminals 40*a* and 40*b*, trigger 42 changes thyristor 40 from the blocking state to the conducting state which allows current to flow through the heater 36. Depending on the forward current magnitude, the voltage drop across the main terminals 40*a*, 40*b* of the thyristor 40 can be as high as a few volts. This voltage drop is converted from an alternating current voltage to a direct current voltage by the bridge 44. Capacitor 46 smoothes out the ripple in the output of the bridge 44.

In control circuit 38, the capacitor 46 charges up to approximately the peak of the output voltage on each half cycle that the bridge 44 conducts. The current into the relay 48 is then supplied from the capacitor 46 rather than from the bridge 44 until the point in the next half cycle when the output voltage again equals the voltage across the capacitor 46.

When relay 48 is energized, contact 50 closes allowing current to flow and energize relay 52. This closes contacts 54 and starts the compressor 12. If the heater 36 fails to operate or is disconnected, the current flow in control circuit 38 will be reduced to zero which will change the thyristor 40 from the conducting state to the blocking state, thereby reducing the voltage drop across main terminals 40*a*, 40*b* zeros causing the contact 50 to open. With the contact 50 of relay 48 open, the compressor relay 52 is deenergized causing the contacts 54 to open which disables the compressor 12. With the contacts 54 open, the compressor 12 will not run until the heater 36 is replaced and voltage is reapplied to the power source L1, L2.

What is claimed is:

1. Apparatus for protecting a compressor operating in a refrigeration device such as a heat pump wherein said compressor has a crankcase containing lubricating oil and refrigerant, said apparatus comprising:

heater means for maintaining the lubricating oil and refrigerant in said crankcase at a preselected temperature; and control means connected to a source of electrical power for controlling the operation of said compressor, said control means having current detection means for detecting electrical current in said heater means, said current detection means including a thyristor having a blocking state and a conducting state, said control means also having contact means for connecting said compressor to the electrical power source when said contact means is closed and said thyristor is in the conducting state, said thyristor being changed from the conducting state to the blocking state if no electrical current is detected in said heater means, said thyristor signaling said control means to open said contact means in order to disconnect said compressor from the electrical power source when said thyristor is in the blocking state.

2. The apparatus of claim 1, wherein said control means further comprises a trigger connected to said heater means for changing said thyristor from the blocking state to the conducting state.

3. The apparatus of claim 2, wherein said control means further comprises a full wave bridge or rectifier for converting the voltage drop across said thyristor from an alternating current voltage to a direct current voltage.

4. The apparatus of claim 3, wherein said thyristor has two main terminals connected to said full wave bridge, and a gate connected to said trigger.

5. A method of protecting a compressor operating in a refrigeration device such as a heat pump wherein said compressor has a crankcase containing lubricating oil and heater means for maintaining the lubricating oil at a preselected temperature, said method comprising the steps of:

connecting control means having current detection means for detecting electrical current in said heater means including a thyristor having a blocking state and a conducting state to said heater means;

connecting said control means to a source of electrical power in order to change said thyristor from the blocking state to the conducting state;

connecting said compressor to the electrical power source when said thyristor is in the conducting state;

changing said thyristor from the conducting state to the blocking state if no electrical current is detected in said heater means; and disconnecting said compressor from the electrical power source when said thyristor is in the blocking state.

* * * * *